US010730166B1

(12) United States Patent
Aldredge

(10) Patent No.: US 10,730,166 B1
(45) Date of Patent: Aug. 4, 2020

(54) LOCKING PLIERS

(71) Applicant: Robert L. Aldredge, Englewood, OH (US)

(72) Inventor: Robert L. Aldredge, Englewood, OH (US)

( * ) Notice: Subject to any disclaimer, the term of this patent is extended or adjusted under 35 U.S.C. 154(b) by 0 days.

(21) Appl. No.: 16/601,680

(22) Filed: Oct. 15, 2019

(51) Int. Cl.
*B25B 7/12* (2006.01)
*B25B 7/14* (2006.01)
*B25B 7/02* (2006.01)

(52) U.S. Cl.
CPC ..... *B25B 7/123* (2013.01); *B25B 7/02* (2013.01); *B25B 7/14* (2013.01)

(58) Field of Classification Search
CPC ..... B25B 7/123
USPC ..... 91/373, 377; 81/373, 377
See application file for complete search history.

(56) References Cited

U.S. PATENT DOCUMENTS 2,420,020 A * 5/1947 Snell ..... B25B 7/123 81/377
2,681,583 A * 6/1954 Buschman ..... B25B 7/123 81/368
5,056,385 A * 10/1991 Petersen ..... B25B 7/02 81/367
8,656,813 B1 * 2/2014 Aldredge ..... B25B 7/12 81/368
9,682,463 B1 6/2017 Aldredge et al.

* cited by examiner

*Primary Examiner* — Hadi Shakeri
*Assistant Examiner* — Makena S Markman
(74) *Attorney, Agent, or Firm* — Donald J. Ersler

(57) ABSTRACT

A locking pliers preferably includes a fixed jaw, a moveable jaw, a fixed handle, a toggle link, a power link and a jaw link. The fixed jaw is retained in one end of the fixed handle and the moveable jaw is pivotally retained in the one end thereof. An adjustment screw is retained in an opposing end of the fixed handle and engages a first end of the toggle link. A first end of the jaw link is pivotally engaged with a second end of the toggle link. A second end of the jaw link is pivotally engaged with the moveable jaw. One end of a moveable handle is pivotally engaged with a middle of the jaw link. One end of the power link is pivotally engaged with the moveable handle and an opposing end is pivotally engaged with the second end of the toggle link.

12 Claims, 4 Drawing Sheets

LOCKING PLIERS

BACKGROUND OF THE INVENTION

1. Field of the Invention

The present invention relates generally to hand tools and more specifically to a locking pliers, which requires less effort to operate than that of the prior art.

2. Discussion of the Prior Art

U.S. Pat. No. 5,056,385 to Petersen discloses a compound toggle link. U.S. Pat. No. 9,682,463 to Aldredge et al. discloses a locking pliers.

Accordingly, there is a clearly felt need in the art for a locking pliers, which requires less effort to operate than that of the prior art.

SUMMARY OF THE INVENTION

The present invention provides a locking pliers, which requires less effort to operate than that of the prior art. The locking pliers preferably includes a fixed jaw, a moveable jaw, a fixed handle, an adjusting screw, a toggle link, at least one power link, at least one jaw link and a moveable handle. The fixed jaw, the moveable jaw, the fixed handle, the adjusting screw and a biasing spring are preferably taken from an Irwin item no. 502L3 vise grips, but other parts may also be used. U.S. Pat. No. 5,056,385 is hereby incorporated into this patent application by reference in its entirety. The fixed jaw is retained in one end of the fixed handle and the adjusting screw is threadably retained in an opposing end of the fixed handle. The moveable jaw is pivotally retained in the one end of the fixed handle.

The toggle link preferably includes a first toggle end, a second toggle end and a power projection. A curved surface is formed in the first toggle end to receive an end of the adjusting screw. The power projection extends outward substantially perpendicular from the second toggle end. A power hole is formed through an end of the power projection. Each power link includes a first power end and a second power end. Each jaw link includes a first jaw end and a second jaw end. The second toggle end of is pivotally engaged with the first jaw end with a jaw pin. It is preferable to have two jaw links, which are retained on opposing sides of the toggle link. The second jaw end is pivotally retained on an end of the moveable jaw with a second jaw pin. The moveable handle includes a U-shaped cross section, a jaw hole and a power hole. The jaw hole is formed through one end of the moveable handle. The power hole is formed through the moveable handle, behind the jaw hole and below the jaw hole.

A handle hole is formed through the jaw link between the first jaw end and the second jaw end. The power link includes a link hole formed through the first power end and a power hole formed through a second power end. A first handle pin is retained in the jaw hole in the moveable handle and in the at least one handle hole in the jaw link to pivotally retain the moveable handle relative to the jaw link. A first power pin is retained in the power hole in the moveable handle and in the power hole in the power link to pivotally retain the moveable handle relative to the power link. A second power pin is retained in the link hole in the power link and the power hole in the power projection to pivotally retain the power link with the toggle link.

Accordingly, it is an object of the present invention to provide a locking pliers, which requires less effort to operate than that of the prior art.

These and additional objects, advantages, features and benefits of the present invention will become apparent from the following specification.

DETAILED DESCRIPTION OF THE PREFERRED EMBODIMENTS

Figure 1:
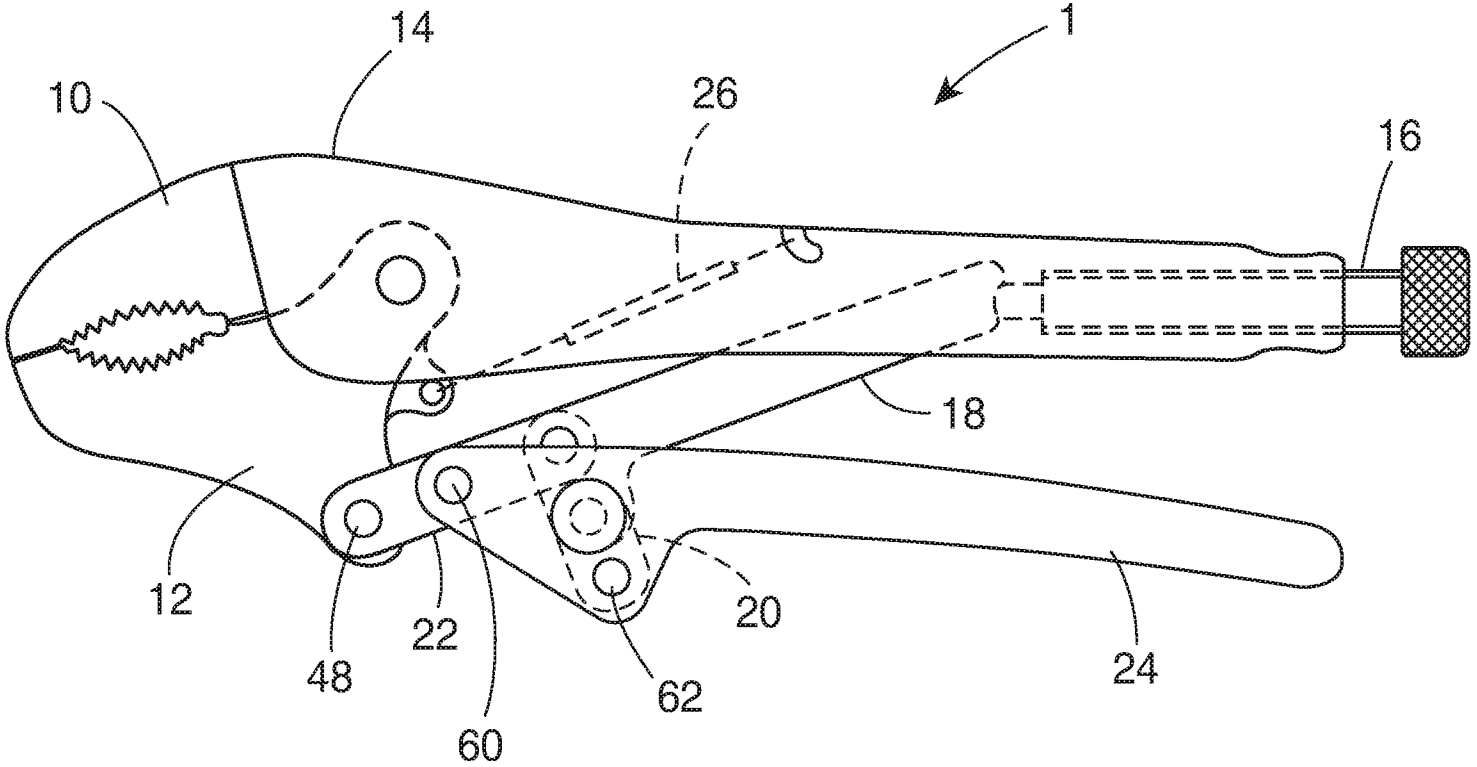
FIG. 1 is a side view of a locking pliers in a closed orientation in accordance with the present invention.
Figure 2:
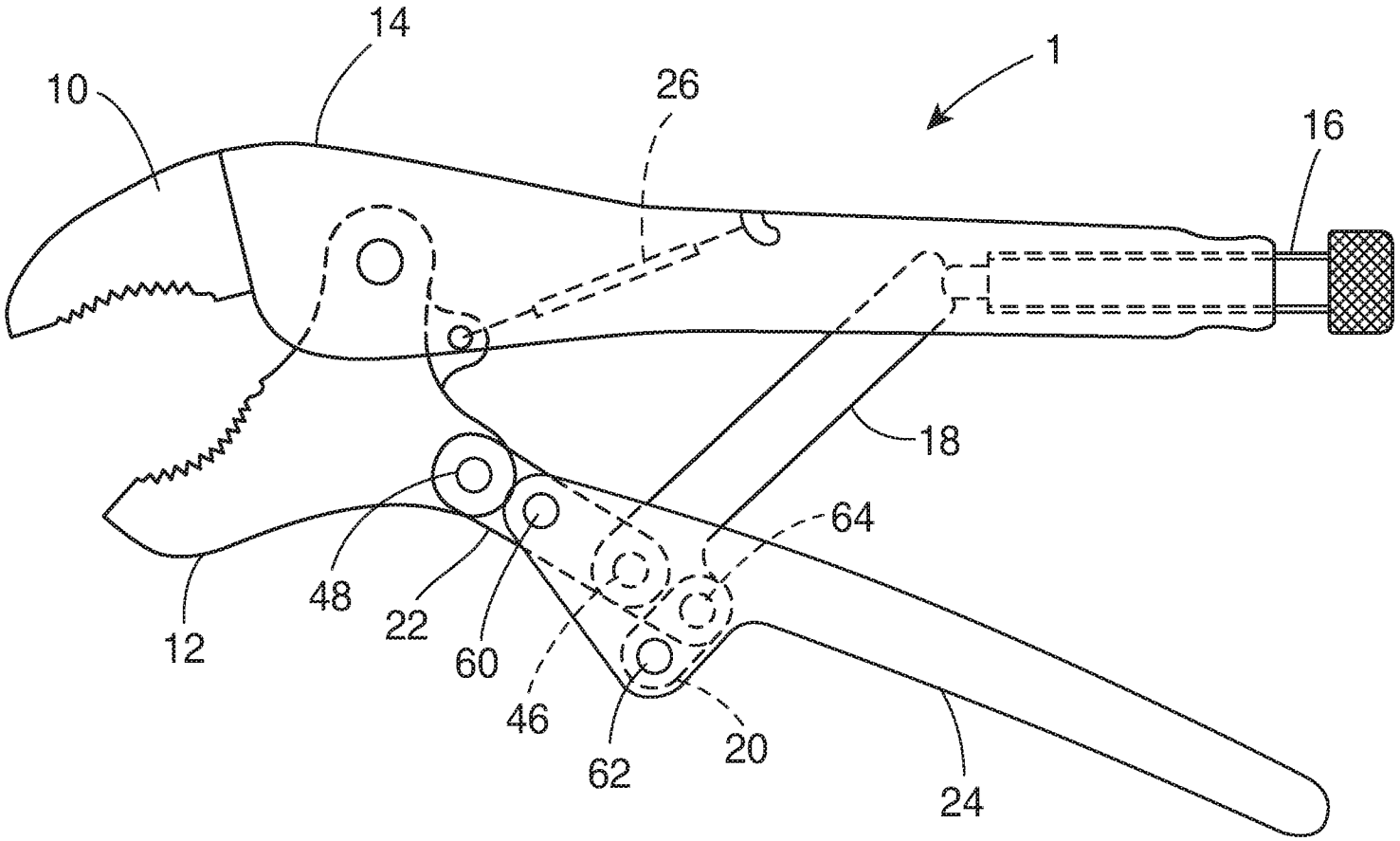
FIG. 2 is a side view of a locking pliers in an open orientation in accordance with the present invention.

With reference now to the drawings, and particularly to FIG. 1, there is shown a side view of a locking pliers 1 in a closed orientation. With reference to FIGS. 2-5, the locking pliers 1 preferably includes a fixed jaw 10, a moveable jaw 12, a fixed handle 14, an adjusting screw 16, a toggle link 18, at least one power link 20, at least one jaw link 22 and a moveable handle 24. The fixed jaw 10, the moveable jaw 12, the fixed handle 14, the adjusting screw 16 and a biasing spring 26 are preferably taken from an Irwin item no. 502L3 vise grips, but other parts may also be used. U.S. Pat. No. 5,056,385 is hereby incorporated into this patent application by reference in its entirety. The fixed jaw 10 is retained in one end of the fixed handle 14 and the adjusting screw 16 is threadably retained in an opposing end of the fixed handle 14. The moveable jaw 12 is pivotally retained in the one end of the fixed handle 14.

Figure 3:
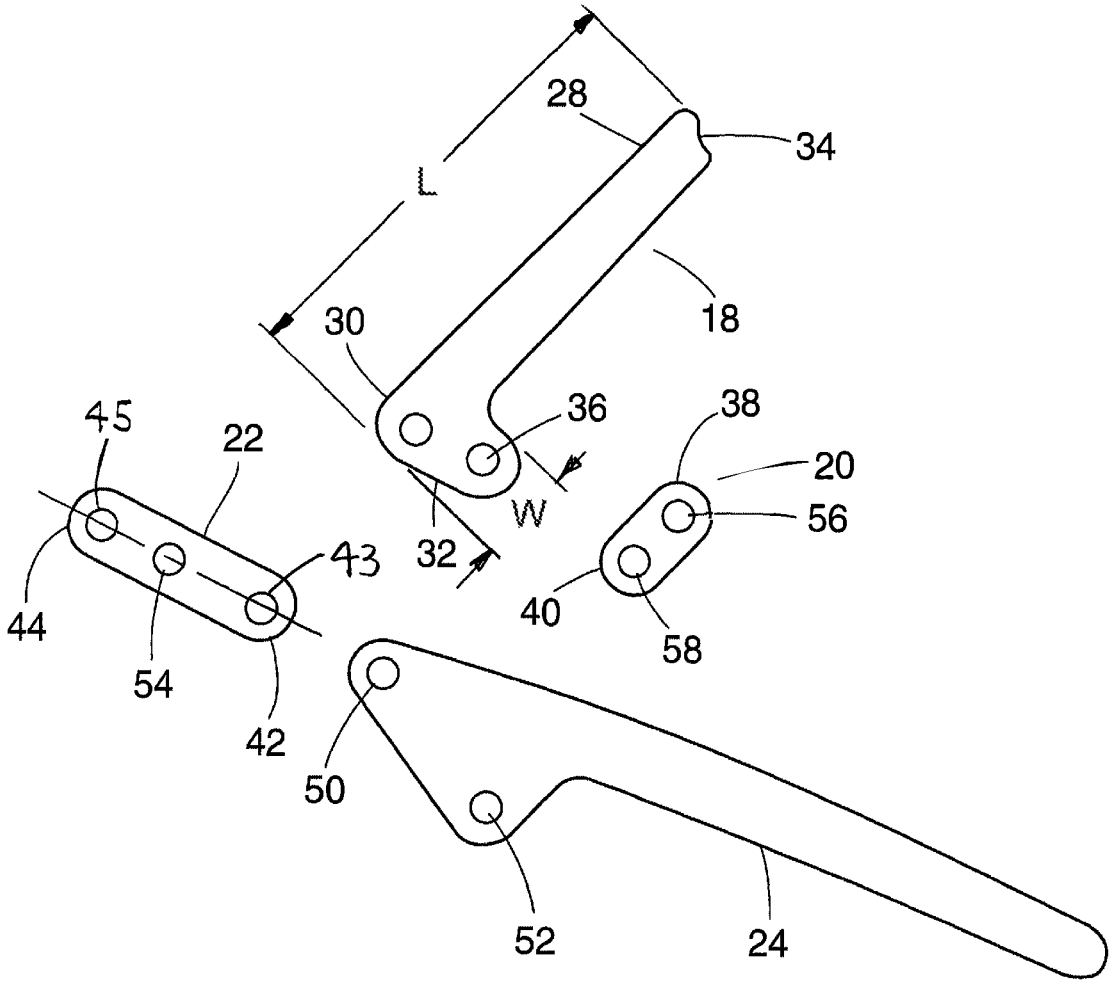
FIG. 3 is an exploded side view of a toggle link, a power link, a jaw link and a moveable handle of a locking pliers in an open orientation in accordance with the present invention.
Figure 4:
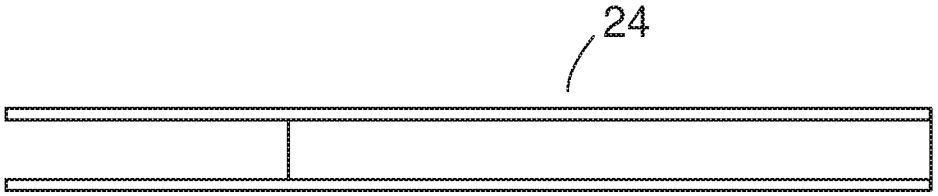
FIG. 4 is a top view of a moveable handle of a locking pliers in accordance with the present invention.
Figure 5:
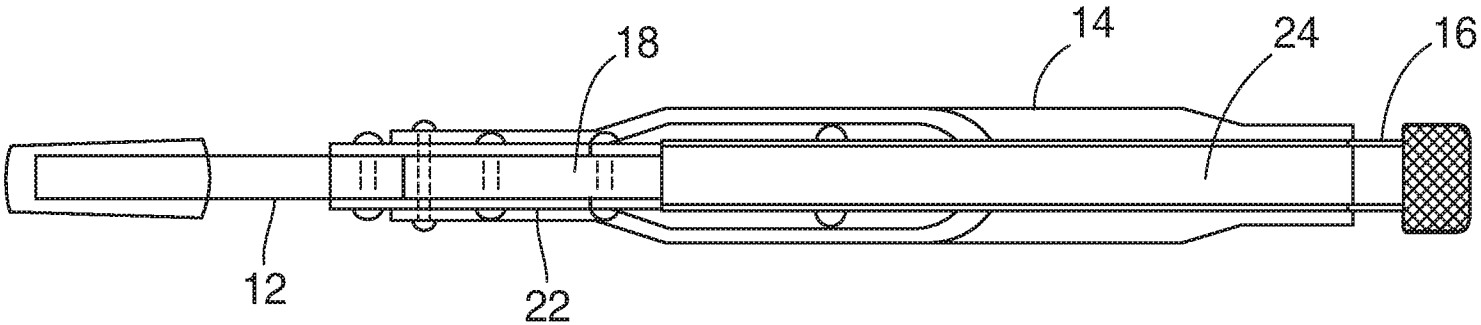
FIG. 5 is a bottom view of a locking pliers in a closed orientation in accordance with the present invention.

The toggle link 18 preferably includes a base portion 27 and a power projection 32. The base portion 27 includes a first toggle end 28 and a second toggle end 30. The power projection 32 extends beyond said base portion at the second toggle end 30. A width "W" of the power projection 32 is less than half a length "L" of the base portion 27. A curved surface 34 is formed in the first toggle end 28 to receive an end of the adjusting screw 16. The power projection 32 preferably extends outward substantially perpendicular from the second toggle end 30 of the toggle link 18. A power hole 36 is formed through an end of the power projection 32. The power hole 36 is not formed through the base portion 27. Each power link 20 includes a first power end 38 and a second power end 40. Each jaw link 22 includes a first jaw end 42 and a second jaw end 44. The second toggle end 30 of the toggle link 18 is pivotally engaged with the first jaw end 42 of the at least one jaw link 22 with a jaw pin 46. It is preferable to have two jaw links 22, which are retained on opposing sides of the toggle link 18. The second jaw end 44 of the at least one jaw link 22 is pivotally retained on an end of the moveable jaw 12 with a second jaw pin 48. With reference to FIGS. 3-4, the moveable handle 24 includes a U-shaped cross section, a jaw hole 50 and a power hole 52. The jaw hole 50 is formed through one end of the moveable handle 24. The power hole 52 is formed through the moveable handle 24, behind the jaw hole 50 and below the jaw hole 50.

A handle hole 54 is formed through the jaw link 22 between the first jaw end 42 and the second jaw end 44. A link hole 43 is formed through the first jaw end 42 and a jaw hole 45 is formed through the second jaw end 44. The link hole 43, the jaw hole 45 and the handle hole 54 all lie on the same axis. The power link 20 includes a link hole 56 formed through the first power end 38 and a power hole 58 formed through the second power end 40. A first handle pin 60 is retained in the jaw hole 50 in the moveable handle 24 and in the at least one handle hole 54 in the jaw link 22 to pivotally retain the moveable handle 24 relative to the jaw link 22. A first power pin 62 is retained in the power hole 52 in the moveable handle 24 and in the power hole 58 in the power link 22 to pivotally retain the moveable handle 24 relative to the power link 22. A second power pin 64 is retained in the link hole 56 in the power link 22 and the power hole 36 in the power projection 32 to pivotally retain the power link 22 with the toggle link 18.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A locking pliers comprising:

a fixed handle having an adjusting device disposed on one end;

a fixed jaw is rigidly retained in an opposing end of the fixed handle;

a moveable jaw is pivotally retained in substantially the opposing end of the fixed handle;

a toggle link having a first toggle end and a second toggle end, said first toggle end is in contact with an end of said adjusting device;

at least one jaw link having a first jaw end and a second jaw end, said first jaw end is pivotally retained with said second toggle end, said second jaw end is pivotally engaged with said moveable jaw;

a moveable handle having one end pivotally engaged with said at least one jaw link between said first jaw end and said second jaw end, a first pivot point of said second toggle end, a second pivot point of said moveable jaw at said second jaw end, and a third pivot point of said moveable handle on said at least one jaw link lie on the same axis; and a power link having one end pivotally engaged with said moveable handle, an opposing end of said power link is pivotally engaged with said second end of said toggle link.

2. The locking pliers of claim 1 wherein:

said adjusting device is an adjustment screw.

3. The locking pliers of claim 1 wherein:

said moveable handle includes a U-shaped cross section.

4. A locking pliers comprising:

a fixed handle having an adjusting device disposed on one end;

a fixed jaw is rigidly retained in an opposing end of the fixed handle;

a moveable jaw is pivotally retained in substantially the opposing end of the fixed handle;

a toggle link having a first toggle end, a second toggle end and a power projection, said first toggle end is in contact with an end of said adjusting device, said power projection extends from said second toggle end;

at least one jaw link having a first jaw end and a second jaw end, said first jaw end is pivotally retained with said second toggle end, said second jaw end is pivotally engaged with said moveable jaw;

a moveable handle having one end pivotally engaged with said at least one jaw link between said first jaw end and said second jaw end, a first pivot point of said second toggle end, a second pivot point of said moveable jaw at said second jaw end, and a third pivot point of said moveable handle on said at least one jaw link lie on the same axis; and a power link having one end pivotally engaged with said moveable handle, an opposing end of said power link is pivotally engaged with said power projection.

5. The locking pliers of claim 4 wherein:

said adjusting device is an adjustment screw.

6. The locking pliers of claim 4 wherein:

said moveable handle includes a U-shaped cross section.

7. The locking pliers of claim 4 wherein:

said power projection extends substantially perpendicular from said second toggle end.

8. A locking pliers comprising:

a fixed handle having an adjusting device disposed on one end;

a fixed jaw is rigidly retained in an opposing end of the fixed handle;

a moveable jaw is pivotally retained in substantially the opposing end of the fixed handle;

a toggle link having a base portion and a power projection, said base portion includes a first toggle end and a second toggle end, said power projection extends outward from said base portion at said second toggle end, a width of said power projection is less than half a length of said base portion;

at least one jaw link having a first jaw end and a second jaw end, said first jaw end is pivotally retained in said second toggle end, said second jaw end is pivotally engaged with said moveable jaw;

a moveable handle having one end pivotally engaged with said at least one jaw link, a first pivot point of said second toggle end, a second pivot point of said moveable jaw at said second jaw end, and a third pivot point of said moveable handle on said at least one jaw link lie on the same axis; and a power link having one end pivotally engaged with said moveable handle behind said at least one jaw link, an opposing end of said power link is pivotally engaged only with said power projection.

9. The locking pliers of claim 8 wherein:

said adjusting device is an adjustment screw.

10. The locking pliers of claim 8 wherein:

said moveable handle includes a U-shaped cross section.

11. The locking pliers of claim 8 wherein:

said power projection extends substantially perpendicular from said second toggle end.

12. The locking pliers of claim 8 wherein:

a power hole is formed through said power projection, but not through said base portion, said opposing end of said power link is pivotally engaged with said power hole.

* * * * *